US005280686A

United States Patent [19]

Davies

[11] Patent Number: 5,280,686

[45] Date of Patent: Jan. 25, 1994

[54] SLIDING WINDOW OR DOOR ARRANGEMENT

[75] Inventor: Lawrence W. Davies, Winnipeg, Canada

[73] Assignee: Omniglass Ltd., Winnipeg, Canada

[21] Appl. No.: 983,614

[22] Filed: Nov. 30, 1992

Related U.S. Application Data

[63] Continuation of Ser. No. 666,186, Mar. 7, 1991, abandoned.

[51] Int. Cl.[5] ..... E05D 15/10

[52] U.S. Cl. ..... 49/209; 49/404; 49/454; 49/406; 49/425; 52/207

[58] Field of Search ..... 49/209, 210, 211, 50, 49/404, 406, 425, 449, 453, 454, 503; 52/207

[56] References Cited

U.S. PATENT DOCUMENTS

| | | | |
|---|---|---|---|
| 1,459,668 | 6/1923 | Barr | 49/209 |
| 2,511,341 | 6/1950 | Johnson | 49/454 X |
| 2,609,572 | 9/1952 | Bartlett | 49/454 X |
| 3,805,452 | 4/1974 | Scott | 49/454 |
| 3,827,184 | 8/1974 | Pennec et al. | 49/449 |
| 4,375,737 | 3/1983 | Buzzella | 49/454 X |
| 4,674,246 | 6/1987 | Giguere | 49/404 X |
| 4,944,118 | 7/1990 | Biro | 52/207 X |
| 5,099,624 | 3/1992 | Valentin | 52/207 |

FOREIGN PATENT DOCUMENTS 1078258 5/1980 Canada .

OTHER PUBLICATIONS

Newspaper advertising.

*Primary Examiner*—Peter M. Cuomo
*Assistant Examiner*—Jerry Redman
*Attorney, Agent, or Firm*—Adrian D. Battison; Stanley G. Ade; Murray E. Thrift

[57] ABSTRACT

A sliding door system includes an outer frame, a fixed door panel and a sliding door panel. The outer frame is formed from four frame elements of the same profile which can thus be mitered and connected by corner inserts. The sliding door panel sits on a saddle provided on the outer frame and slides longitudinally of the saddle. A weatherstrip element is carried on the sliding door panel between the saddle and a recess straddling the saddle. The sliding door panel is biased away from contact between the weatherstrip and the saddle but is moved transversely as it reaches the closed position by wedge members at the front edge and by a locking system at the rear edge to compress the weatherstrip to improve the sealing effect. A portion of the saddle is removed adjacent the fixed door panel to allow the sliding door panel to be removed from the top edge.

23 Claims, 5 Drawing Sheets

SLIDING WINDOW OR DOOR ARRANGEMENT

This application is a continuation of application Ser. No. 666,186, filed Mar. 7, 1991 now abandoned.

BACKGROUND OF THE INVENTION

This invention relates to a sliding window or door construction of the type including an outer frame formed from four elongate elements forming respectively a first post, a second post, a horizontal top rail and a horizontal bottom sill; a fixed panel mounted within the outer frame and a sliding panel mounted in the outer frame for sliding movement from a position adjacent one post against which the sliding panel closes toward the second post to overlap the fixed panel. Devices of this type can be used in a patio door set or as smaller panels in a simple sliding window arrangement.

A number of problems arise with constructions of this type. Firstly the weatherstripping arrangement which is essential to provide sealing between the sliding panel and the outer frame around three sides of the sliding panel and between the sliding panel and the fixed panel along a centre section must receive adequate pressure in the closed position to ensure a proper sealing action while this pressure can interfere with the proper sliding action. Proposals to solve this problem are shown in Canadian Patent 1,078,258 (Allen). In this arrangement the outer frame carries a plurality of wedges against which the sliding panel moves as it approaches the closed position. These wedges action to move the sliding panel transversely to its sliding direction to compress the weatherstripping solely at the closed position while releasing the strong compression when the panel moves away from the closed position. To some extent, therefore, this alleviates the high friction and high wear which are obtained if the sliding panel continually slides against the weatherstripping while under compression. However the design shown is very unsatisfactory and has achieved little commercial success.

Other designs currently available on the marketplace, for example a design manufactured by In-Line Manufacturing Inc. of Toronto, provides highly complex hardware in which an initial action of the door is to move significantly away from contact with the frame and then to slide in the normal sliding direction in the manner of action of an aircraft door or a side sliding door of the type used in many cases on a van. However a design of this type in a sliding door set is less satisfactory in view of the relatively high cost and complexity of the hardware to allow this sliding action.

SUMMARY OF THE INVENTION

It is one object of the present invention, therefore, to provide an improved construction for a sliding door or window set.

It is a further object of the present invention to provide an improved construction for an improved sliding door or window set in which the sealing effect of the weatherstripping is enhanced while at the same time allowing release of the weatherstripping during the sliding action to reduce the wear and frictional effects.

It is a further object of the present invention to provide an improved construction of sliding door or window set in which the outer frame can be formed from continuously longitudinally molded parts which have mitered corners thus allowing the construction to be more readily formed without the necessity for filler pieces and the like.

It is yet a further object of the present invention to provide an improved construction of sliding door or window set in which the outer frame is shaped in a manner which prevents the sliding panel from simply being lifted out of location even when locked, which is a common form of forced entry through sliding door sets of this type, while at the same time allowing ready installation of the sliding door panel within the outer frame.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
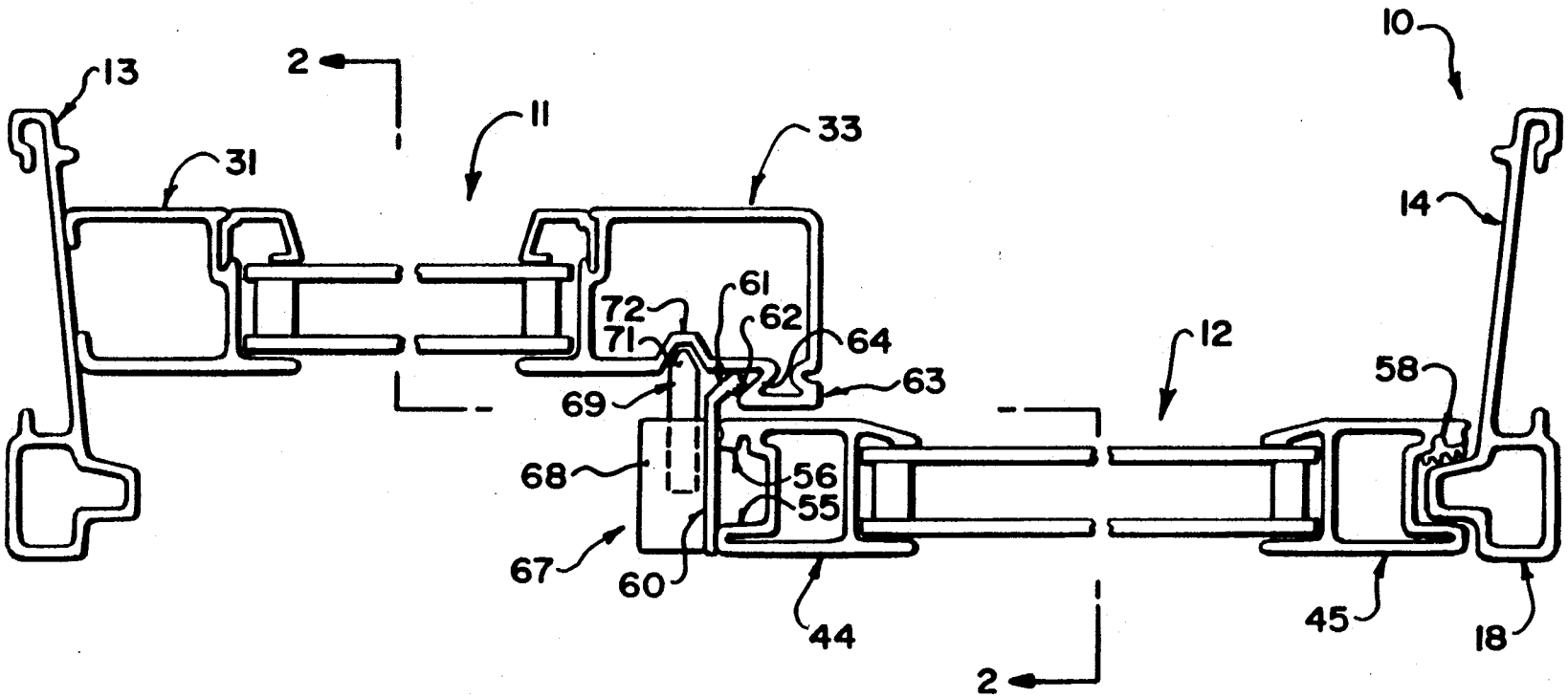
FIG. 1 is a cross-sectional view taken in a horizontal plane through a sliding door set according to the present invention.

The sliding door set is illustrated in the above drawings and comprises an outer frame generally indicated at 10, a fixed door panel generally indicated at 11 and a sliding door panel generally indicated at 12. Although illustrated as a door set, the same concepts can be used in a window which is of course simply the same construction but generally of smaller dimensions. Although illustrated with the sliding door panel on the right hand side, slidable toward the left hand side, it will be appreciated that the construction can be reversed in view of the symmetry of the arrangement, as will be apparent from the following detailed description.

Each of the profiles forming the outer frame, sliding door panel and fixed door panel is formed preferably by a pultrusion technique from glass fibre reinforced thermosetting resin material. This provides a profile which has the advantages of low thermal conductivity and a coefficient of thermal expansion which is very similar to that of glass so that more simple constructions of sealant can be used in view of the reduced differential expansion that must be accommodate by the sealant arrangements. Pultrusion is of course a known technique and the details of manufacture of the profiles will not be described herein.

The outer frame is formed from four frame elements defining a first vertical post 13, a second vertical post 14, a horizontal top rail 15 and a horizontal bottom sill 16. Each of the frame elements is formed from the same profile simply cut to length from a continuously formed pultruded section. As the profiles of the four frame elements are the same, the profiles can be attached each to the next at respective corners by mitering the corners as shown best in FIG. 6 where the mitered edges of the top corners are indicated at 15A and 15B respectively. The corner construction is completed by the insertion of a mechanical corner member 17 which is inserted into the hollow portion of the profile and includes a pair of legs arranged at right angles shaped to fill or substantially fill the hollow interior of the profile to provide strength at the corner and to hold the corner portions together.

Figure 2:
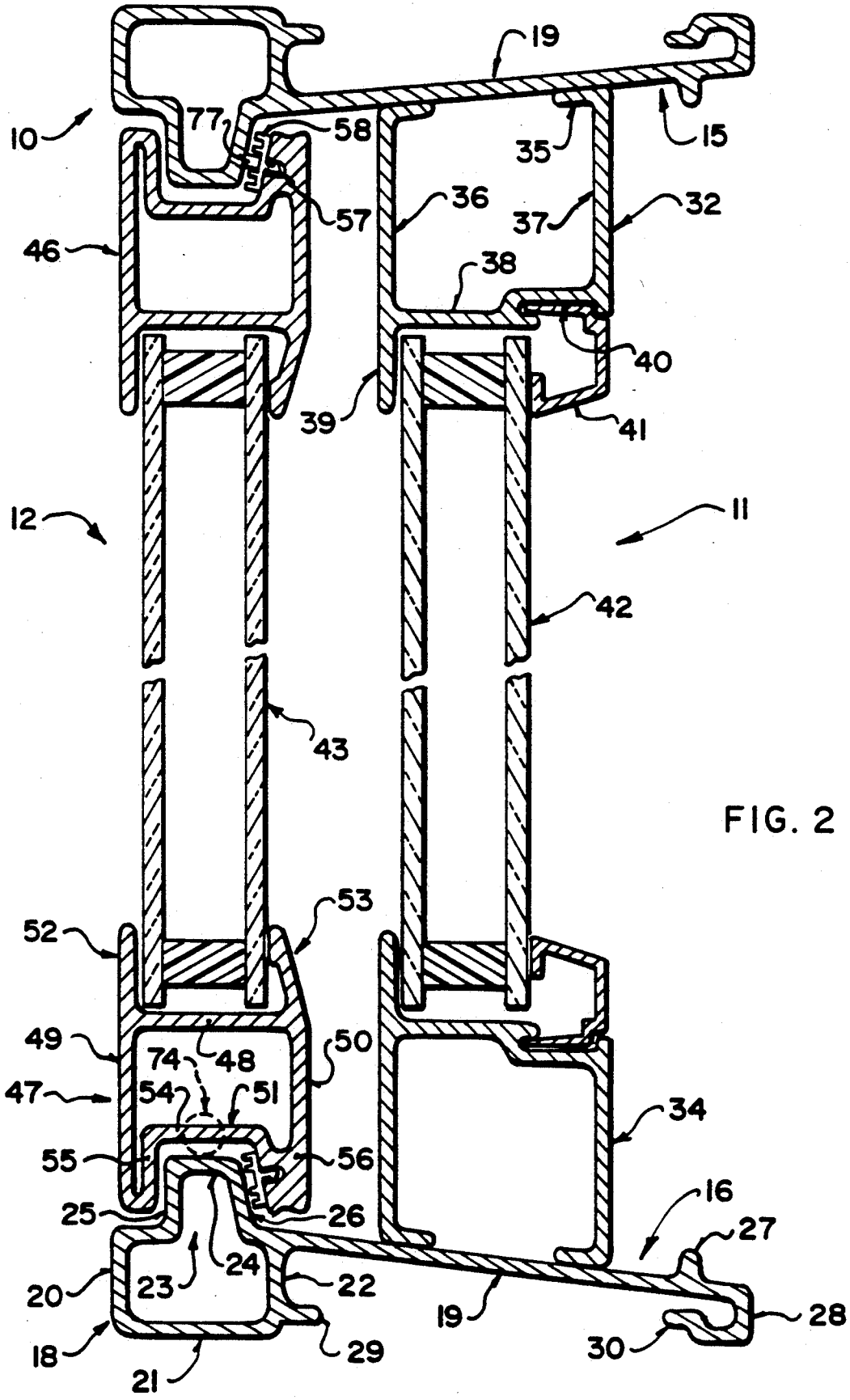
FIG. 2 is a cross-sectional view along the lines 2—2 of FIG. 1.

The profile is best shown in FIG. 2 and comprises a hollow saddle section 18 and a sill section 19 formed integrally together by the pultrusion technique. The hollow saddle section 18 includes a lower rectangular portion defined by a vertical front wall 20, a horizontal base wall 21 and a vertical intermediate wall 22. On top of the saddle section is provided the saddle member 23 which forms a raised hollow rib along the upper surface of the rectangular section. The rib includes an upper surface 24 and two side surfaces 25 and 26 which depend downwardly from the upper surface to form a saddle over which the edge of the sliding door straddles as described hereinafter. From the top of the rectangular section of the saddle section, the inner edge of the sill portion 19 depends and extends therefrom downwardly and outwardly to a rib 27 and an underlying support portion 28. The support portion 28 can rest upon or engage the building framework. A flange 29 and a flange 30 project from the inside edge of the wall 22 and the inside edge of the support 28 respectively inwardly toward one another at a position recessed from the undersurface defined by the bottom of the wall 21 and the bottom of the support portion 28. These flanges 29 and 30 receive the corner member inserted in the hollow interior above the flanges 29 and 30 following which screws are fastened through the flanges 29 and 30 to hold the corner member in place relative to the frame element.

The fixed door panel includes four frame members including a first vertical post 31 attached to the vertical post 13 of the outer frame, a horizontal top rail 32 attached to the top rail 15, a horizontal bottom rail 34 attached to the sill 16 and a central vertical post 33 positioned midway across the outer frame and extending from the top rail to the bottom sill. The first three of the above profiles are identical and include simply a hollow section with an outer wall 35 attached to the upper surface of the sill portion 19, vertical walls 36 and 37 and a glass receiving wall 38. The glass receiving wall includes a retaining flange 39 and a snap receptacle 40 for a glass locating element 41. The element 41 can be snapped into place against the sealed window unit or glazing 42 to hold the glazing in place against the flange 39. Suitable sealants are provided but are not shown in the drawings. The profiles being substantially identical can be mitered together at the corners as previously described using corner inserts to hold the elements in proper location. The centre post 33 is identical in width to the remaining posts but has an additional portion on its outer face and will be described hereinafter for cooperation with the sliding door panel. The shape therefore allows the mitering effect to take place but with the additional piece of the post 33 projecting outwardly from the mitered corner.

The raised position of the glass supporting wall 38 provided by the wall 36 and 37 is provided in order to maintain the size of the glazing 42 equal to the size of the glazing 43 provided in a sliding door panel; but if this is not required the glass support wall 38 can be provided directly by or directly upon the sill portion 19.

The sliding door panel 12 is formed from four frame elements including a first vertical post 44, a second vertical post 45, a top rail 46, and a bottom rail 47. Each of the frame elements is of the same profile so that again the corners can be formed by mitering and the insertion of a corner support element. The profile includes an upper glass support wall 48, a pair of spaced vertical walls 49 and 50 and a lower straddling wall 51. The glass support wall 48 includes a pair of flanges 52 and 53 shaped to confine between them the glazing section 43. The straddling wall 51 includes a horizontal section 54 and a pair of depending elements 55 and 56 which project downwardly from the horizontal section and join with the walls 49 and 50 respectively at locations below the horizontal wall 54 so as to straddle the saddle 24. The depending section 55 is substantially vertical and cooperates with or lies adjacent to the substantially vertical front wall 23 of the saddle. The depending portion 56 is inclined downwardly and outwardly so as to lie parallel to the downwardly and outwardly inclined outer wall 26 of the saddle 24. The depending portion 56 and the wall 50 combine to form a lower body portion which is thicker than the remaining walls of the part so as to receive a recess 57 into which is mounted a conventional weather stripping element 58. The weatherstripping element includes a barb 59 projecting into the recess and snap fastened therein by a barb element deep within the recess. Outside of the recess is provided a resilient weatherstrip surface projecting outwardly away from the recess and defined by molded strips which can flex when brought into contact with an adjacent surface to provide a sealing effect between the body 56 and the surface contacted by the weatherstrip element.

As best shown in FIG. 2 the weather strip element 58 cooperates with the inclined wall 26 of the saddle and can be pressed against that wall in a sealing action.

Each of the front vertical post 45, top rail 46 and bottom rail 47 carries a strip of the weatherstrip element 58 along the recess 57 thereof as shown in FIGS. 1 and 2. The rear vertical post 44 however has no element for engagement with the respective surface 56 thereof as shown in FIG. 1 and therefore there is provided a separate weatherstrip construction mounted on the rear vertical post 44 for cooperation with the central vertical post 33 of the fixed door panel.

Specifically the rear vertical post 44 carries a bracket 60 in the form of a flat plate attached to the outer most surface of the rear post across the recess in the outer face and bridging the surfaces at the outermost edge of the portions 55 and 56. At a position outward of the sliding panel and adjacent the fixed panel, the bracket 60 is cranked at an angle of 45°. On the outer end of the cranked portion indicated at 61 is provided a weatherstrip element 62 which faces toward the sliding panel and toward the front edge of the sliding panel. This weatherstrip cooperates with a triangular shaped projection 63 on the face of the central post 33 adjacent the sliding panel. The triangular shaped projection thus defines a surface 64 which faces toward the weatherstrip 62 that is it is arranged at 45° to the plane of the fixed door panel and faces outwardly of the building and away from the sliding door panel. The weatherstrip 62 is thus brought into engagement with the surface 64 when the door is moved to the fully closed position as shown in FIG. 1 but moves away from the surface 64 as the door is opened.

Figure 5:
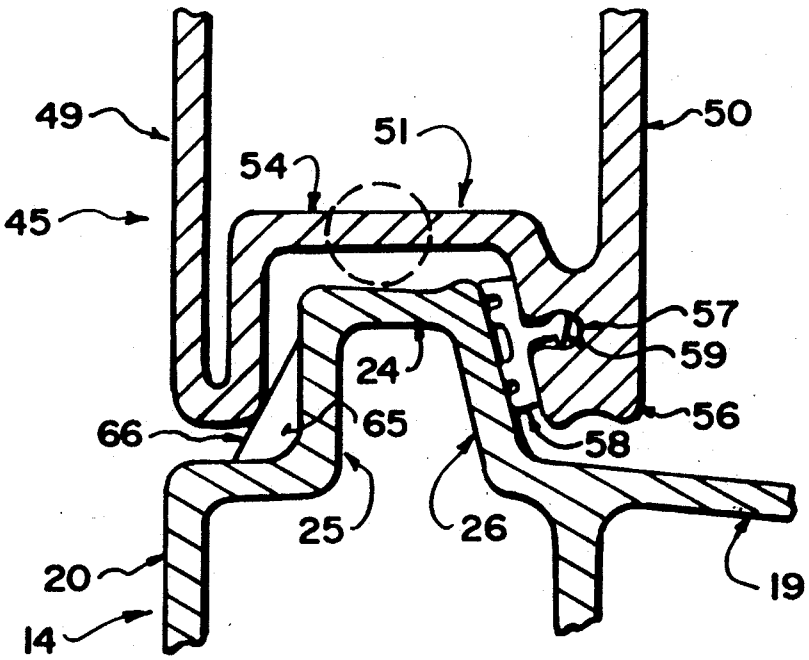
FIG. 5 is a cross-sectional view taken along the lines 5—5 in FIG. 6 showing part of the front post of the sliding door panel and the associated part of the vertical post of the outer frame.
Figure 6:
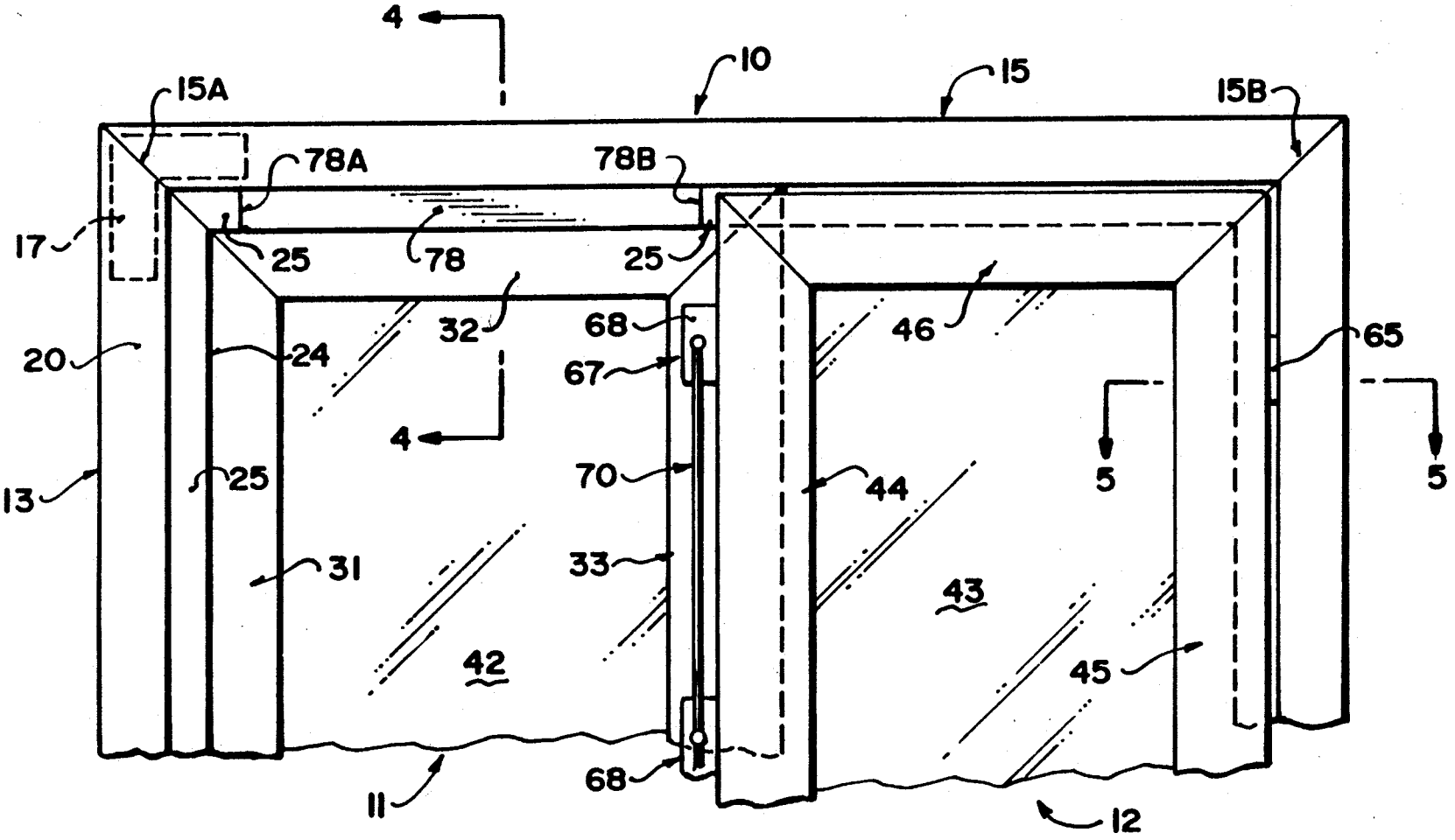
FIG. 6 is a front elevational view of an upper part of the sliding door set of the above figures.

The sliding door panel is designed so that it enables the weatherstrip elements at the front post, top and bottom rails and the rear post to be compressed in the closed position of the door and to be released from the compressive action as soon as the door is moved from the fully closed position. This compressive action is achieved at the front edge of the sliding door panel by a pair of wedge members 65 which are attached to the vertical post 14. As shown in FIGS. 5 and 6, a first one of the wedge members 65 is positioned adjacent a top end of the vertical post 14. The wedge member is located on the saddle at the angle between the wall 25 and the horizontal top wall of the rectangular section of the saddle with a wedge forming a triangular element having an outer wedge surface 66 for engaging the forward most edge of the element 55 of the straddling section of the post 45 of the sliding door panel. A similar second wedge member 65 is positioned at the same location adjacent the bottom of the post 14 so that the front edge of the post 45 of the sliding door panel simultaneously engages the two wedge members and is thus forced away from the wall 25 thus drawing the weatherstrip 58 vigorously into contact with the wall 26.

At a rear edge of the sliding door panel is mounted a lock system generally indicated at 67. The lock system 67 comprises a plurality of lock elements 68 positioned at spaced locations down the rear edge of the sliding door panel.

Each lock element 68 comprises a locking pin 69 which can be moved in a direction at right angles to the plane of the door panel towards and away from the central post 33 of the fixed door panel. Each pin is operated by a lever mechanism (not shown) provided within the lock element 68 with the lever mechanisms of the lock elements being simultaneously actuated by a bar system 70 extending down the full length of the sliding door panel to an actuator element (not shown) preferably at the bottom edge of the door panel so that it can be operated by the foot of the user. In this way the user can actuate the sliding bar system 70 to simultaneously move the pins 69 from a retracted position within the lock element 68 to an extended position into engagement with the central post 33.

Each of the pins 69 has a blunt end 71 which engages into a blind recess 72 provided in the front face of the post 33. The recess is provided in the form of a channel longitudinally of the post but each pin 69 cooperates with a separate portion of the recess or channel 72. As the channel 72 is blind that is it is closed at the base end, movement of the pin 69 has two effects. Firstly when engaged into the recess the pin prevents the sliding panel from moving in the sliding direction so that it is locked in the closed position. Secondly the pin pushes the rear edge of the sliding panel away from the central post 33 so that the weatherstrip 62 is pressed into engagement with the wall 64 in a compressive action to increase the sealing effect of the weatherstrip.

It will be appreciated therefore that the door panel when moved into the closed position and locked is moved through a small distance from its normal track transversely of the sliding direction sufficient merely to act to compress the weatherstrip around the full periphery of the sliding panel. The front edge is moved by the wedge members. The rear edge is moved by the lock members. The top and bottom of the door panel of course are moved with the front and rear edges thus compressing the weatherstrip around the full periphery.

Figure 3:
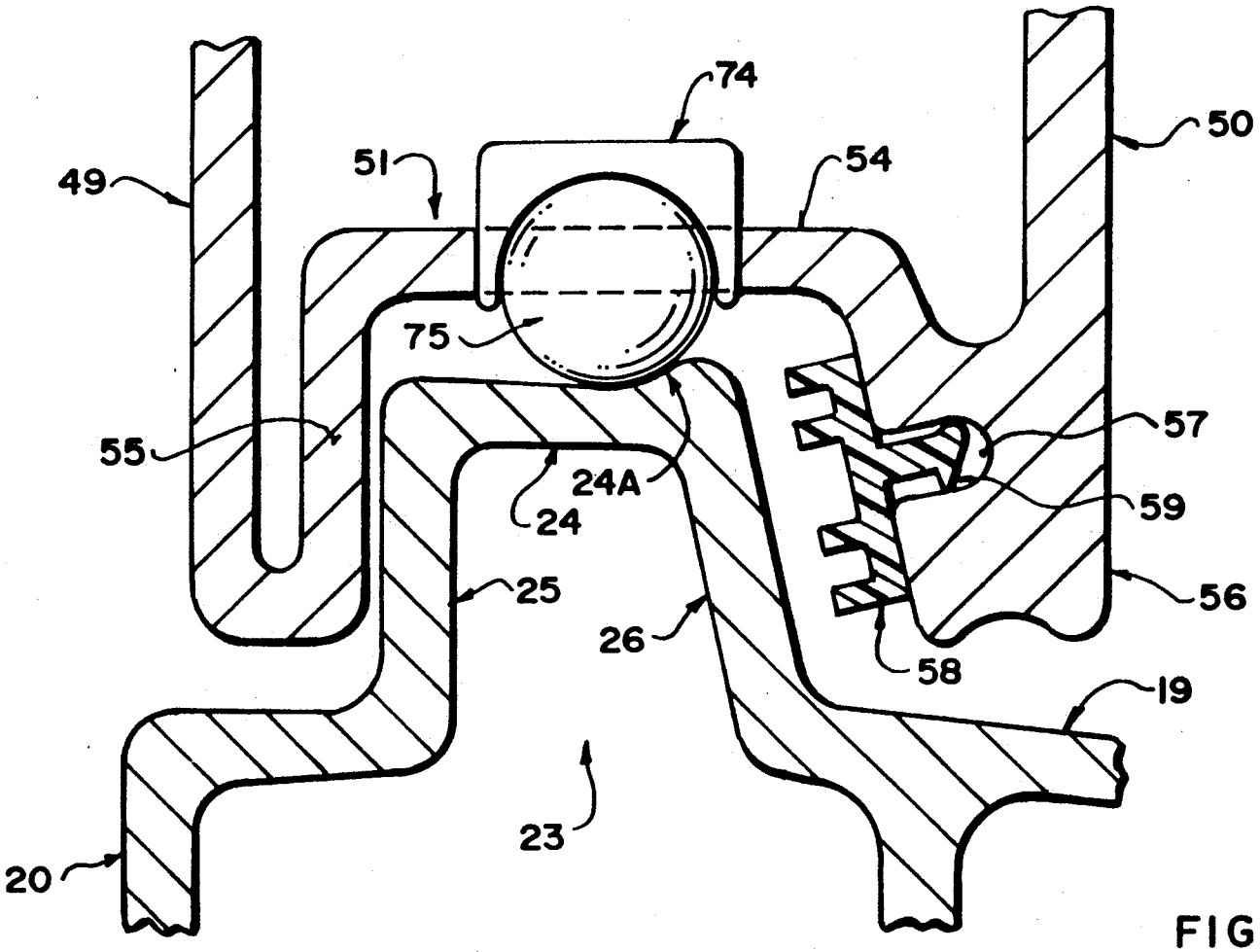
FIG. 3 is a cross-sectional view also along the lines 2—2 on an enlarged scale showing one part only of the sliding door panel and supporting bottom sill shown in FIG. 2.

In order to ensure that in a normal sliding position of the sliding door panel the weatherstrip is removed from the compressive action, suitable biasing means can be provided to slightly push the door panel toward the fixed door panel in its normal sliding action. One example of a device for achieving this biasing effect is shown in FIG. 3 in which a conventional roller system is indicated at 74 including roller balls 75 and a housing supporting the roller balls within the recess 51 on the underside of the sliding door panel. The roller system is of a conventional construction and is therefore not shown in detail and can include adjustment mechanisms by which the height of the door can be adjusted by increasing or decreasing the distance between the lowermost edge of the balls and the support surface 54 on which the housing 74 sits.

In order to bias the sliding panel to the right as shown in FIG. 3, the upper surface 24 of the saddle section 18 is shaped so that it is gradually inclined toward the right up to a stop portion 24A which inclines upwardly to prevent the roller balls from moving too far to the right. The balls thus tend to run offset from the center of the upper surface 24 towards the right thus releasing the weatherstrip from the surface 26. This releases the compressive action on the weatherstrip and prevents high friction during the sliding action which is undesirable for operation and which is undesirable because it tends to cause significant wear on the weatherstrip elements. For convenience of illustration the roller elements are omitted from FIG. 2.

A similar biasing system can be provided at the top of the sliding door panel and this can be simply provided by a spring strip 77 mounted in the recess 57 with the weatherstrip 58 so as to provide a slight force pushing the weatherstrip away from the adjacent saddle. The spring force can then be overcome by compression of the spring strip 77 during the compression action of the weatherstrip element.

The shape of the profile of the outer frame enables a simple mounting of the sliding door panel within the outer frame. The conventional system for mounting the sliding door panel in the outer frame involves providing a deeper track system at the top edge of the door so that the door can be lifted sufficient to remove the lower edge of the door out of the bottom track following which the lower edge can be pulled away and the door dropped out of the track. This conventional system is undesirable in view of the fact that it requires more complex hardware and in view of the fact that it constitutes the most simple technique for breaking into premises having a door system of this type. Often the burglar will simply break into the house by lifting the sliding door panel out of its track enabling him to enter without difficulty.

Figure 4:
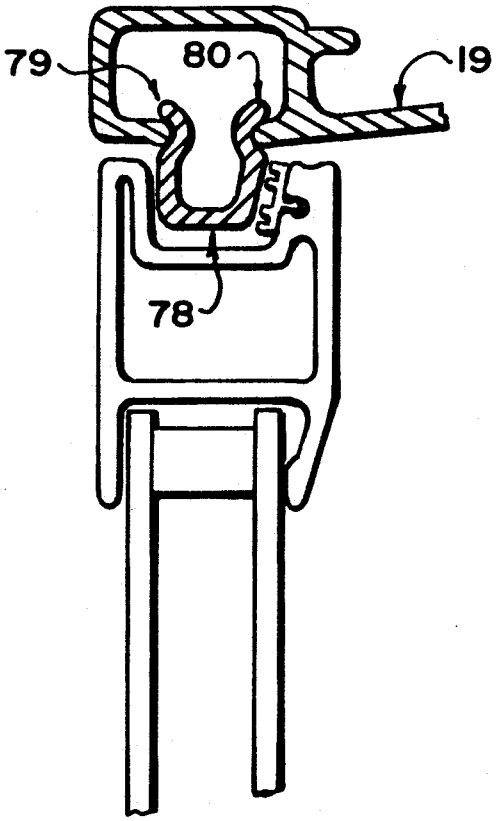
FIG. 4 is a cross-sectional view of an upper part of the sliding door panel and upper frame section taken along the lines 4—4 in FIG. 6 with the sliding door panel in the open position.

In the present invention, as shown in FIG. 2, there is insufficient space for the door to be lifted to release the lower edge so that the door cannot be removed in this manner. However the profile including the saddle 24 is shaped to enable simple insertion and removal of the sliding door panel after the outer frame is installed. This is achieved as shown in FIGS. 4 and 6 by the provision of a separate snap-in element 78. In installation of the device, therefore, a portion of the saddle 24 is removed by cutting generally using a router along a length indicated by the lines 78A and 78B in FIG. 6. This cutting action leaves a slot in the upper wall of the rectangular section of the saddle as best shown in FIG. 4. This slot is then filled by the snap-in element 78 which is shaped to simulate the walls of the saddle but includes a pair of snap legs 79 and 80 which project into the hollow interior of the rectangular section and snap around the edges of the slot previously cut. The appearance of the product is therefore unaltered by the removal of the portion of the profile and the insertion of the snap-in element provided of course the workmanship is carried out carefully. Thus the outer frame remains effectively intact but simply the door can be installed by removal of the snap-in piece, placement of the bottom edge of the door onto the saddle and then insertion of the top edge of the door through the open area between the edges 78A and 78B following which the door can slide toward the closed position and the snap-in piece be inserted to complete the outer frame.

The sliding door system of the present invention therefore provides many improvements in relation to the construction of the frame elements which allow simple assembly of the system by mitering the corners rather than the conventional system of different frame elements which must be assembled and filled by various inserts. Secondly the shape of the outer frame enable simple insertion of the sliding door panel while providing a system which prevents the panel from being simply removed for unauthorized entry. Thirdly the weatherstrip system and slight transverse movement of the door panel to compress the weatherstrip provides a very effective seal but prevents the weatherstrip from being worn or providing excessive friction during the sliding action. The transverse movement can be as low as 1/16 inch which is sufficient merely to provide slight compression of the weatherstrip from a position in which the weatherstrip is just in contact with or slightly spaced away from the relevant surface to a position in which the compression action is sufficient to provide an effective seal.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A sliding door or window set comprising:

an outer frame formed from four separate elongate frame elements each of which is formed from a length of a first continuously longitudinally molded profile of constant cross section, the frame elements being connected at four corners to form a rectangular surrounding frame having a horizontal outer top rail, a horizontal outer bottom sill and a first and a second vertical jamb;

a fixed window panel having a rectangular fixed window frame mounted within the outer frame having a width so as to extend from the first jamb to a position midway across the outer frame and having a height so as to extend from the outer top rail to the outer bottom sill and a glazing member mounted within said fixed window frame, the fixed window frame being formed from at least one separate elongate frame element formed from a length of a second continuously molded profile of constant cross-section and including a central vertical post;

a sliding window panel having a rectangular sliding window frame mounted within the outer frame having a width so as to extend from the second jamb to a position midway across the outer frame and having a height so as to extend from the outer top rail to the outer bottom sill and a glazing member mounted within the sliding window frame, the sliding window frame being formed from four separate elongate frame elements each of which is formed from a length of a third continuously molded profile of constant cross-section and including a horizontal sliding top rail, a horizontal sliding bottom rail, a front vertical post and a rear vertical post;

slide guide means on the outer frame mounting the sliding window panel for movement in a sliding action longitudinally of the outer top rail and outer bottom sill from a closed position at said second jamb toward said first jamb;

each of said top sliding rail, sliding bottom rail and front post of the sliding window panel carrying a longitudinally extending weatherstrip element for engagement with a portion of the outer frame in sealing cooperation therewith in said closed position of the window panel in which said front vertical post is in engagement with said second jamb;

cam means provided at said second jamb engagable with means on the front post of the sliding window frame for moving the sliding window frame in transverse movement relative to its direction of movement, said cam means being positioned such that said transverse movement occurs closely adjacent the closed position of the sliding window panel to press the weatherstrip element on the front post into compressing engagement with said second jamb;

weatherstrip means cooperating between said rear post of said sliding window panel and said central post of said fixed window panel;

and means for moving said sliding window panel transversely to its direction of sliding movement in a compression direction to compress said weatherstrip means.

2. The sliding window set according to claim 1 wherein said means for moving the sliding window panel comprises lock means positioned on said rear post for cooperation with said central post in a locking and moving action.

3. The sliding window set according to claim 2 wherein the lock means comprises a plurality of lock elements arranged at spaced positions longitudinally of the rear post and common actuating means movable by a single action to actuate each of said lock elements.

4. The sliding window set according to claim 2 wherein the lock means includes a pin mounted on the rear post and movable transversely to the rear post into engagement with the central post, the central post having a blind recess therein for receiving an end portion of the pin to prevent sliding movement of the sliding window panel and to move the sliding window panel transversely to its sliding direction.

5. The sliding window set according to claim 1 wherein the weatherstrip means is mounted on the rear post.

6. The sliding window set according to claim 5 including a bracket member mounted on the rear post and extending therefrom toward the central post, the bracket member having an end portion thereof cranked at an angle to a main plane of the sliding window panel and said central post defining a surface thereon at approximately the same angle as the end portion to said plane, said surface facing away from the sliding window panel.

7. The sliding window set according to claim 1 including means on the slide guide means and on the sliding window panel for cooperating therebetween to bias the sliding window panel in a direction away from said compression direction.

8. The sliding window set according to claim 7 wherein said biasing means comprises roller means mounted on one of said horizontal outer bottom sill and said horizontal sliding bottom rail of the sliding window panel and guide surface means provided on the other of said horizontal outer bottom sill and said horizontal sliding bottom rail, the guiding surface being inclined so as to tend to cause the roller means to move transversely while it rolls longitudinally.

9. The sliding window set according to claim 7 including spring blassing means positioned between the outer top rail of the outer frame and the sliding top rail of the sliding window panel and acting to bias the sliding top rail of the sliding window panel transversely to the longitudinal movement.

10. The sliding window set according to claim 1 wherein the four separate elongate frame elements of the outer frame are each formed from the first same molded profile, the corners of the outer frame being formed by mitering ends of the elements.

11. The sliding window set according to claim 10 wherein said first molded profile of the outer frame includes in cross-section a hollow saddle support portion defined by surrounding walls forming a hollow interior and a sill portion extending outwardly from the hollow saddle support portion to one side thereof.

12. The sliding window set according to claim 11 wherein the hollow saddle support portion includes a raised rib on an upper surface and two shoulders formed on respective sides of the rib, each of the sliding top rail, sliding bottom rail, front post and rear post of the sliding window panel having a saddle recess therein for receiving the rib portion such that the rib portion and the saddle recess act to guide longitudinal movement of the sliding window panel.

13. The sliding window set according to claim 12 wherein the saddle recess has a base surface facing outwardly and two side surfaces extending from the base surface to an outermost edge of the sliding window panel and wherein the weatherstrip element is mounted on one of said side surfaces for engagement with a corresponding side surface of the rib portion.

14. The sliding window set according to claim 12 wherein a length of the rib portion is removed from the first molded profile on the horizontal top rail at a position corresponding to an open position of the sliding window panel and wherein there is provided an elongate strip member having an outer surface corresponding in shape to that of the rib portion and a pair of legs shaped to snap into an opening formed in the first molded profile by the removal of the rib portion such that the elongate element can be removed to allow installation and removal of the sliding window panel.

15. The sliding window set according to claim 11 wherein the frame of the fixed window panel is mounted on said sill portion.

16. A sliding door or window set comprising:

an outer frame formed from four separate elongate frame elements each of which is formed from a length of a first continuously longitudinally moulded profile of constant cross section, the frame elements being connected at four corners to form a rectangular surrounding frame having a horizontal outer top rail, a horizontal outer bottom sill and a first and a second vertical jamb;

a fixed window panel having a rectangular fixed window frame mounted within the outer frame having a width so as to extend from the first jamb to a position midway across the outer frame and having a height so as to extend from the outer top rail to the outer bottom sill and a glazing member mounted within the fixed window frame, the fixed window frame being formed from at least one separate elongate frame element formed from a length of a second continuously molded profile of constant cross-section and including a central vertical post;

a sliding window panel having a rectangular sliding window frame mounted within the outer frame having a width so as to extend from the second jamb to a position midway across the outer frame and having a height so as to extend from the outer top rail to the outer bottom sill and a glazing member mounted within the sliding window frame, the fixed window frame being formed from four separate elongate frame elements each of which is formed from a length of a third continuously molded profile of constant cross-section and including a horizontal sliding top rail, a horizontal sliding bottom rail, a front vertical post and a rear vertical post;

slide guide means on the outer frame mounting the sliding window panel for movement in a sliding action longitudinally of the outer top rail and the outer bottom sill from a closed position at said second jamb toward said first jamb;

first weatherstrip means between the sliding window panel and the outer frame to provide sealing cooperation therebetween in said closed position of the sliding window panel jamb; in which said front post is in engagement with said second cam means provided at said second jamb engagable with means on the front post of the sliding window frame for moving the sliding window panel frame in transverse movement relative to its direction of movement, said cam means being positioned such that said transverse movement occurs closely adjacent the closed position of the sliding window panel to press the first weatherstrip means into compressing engagement between said front post and said second jamb;

second weatherstrip means cooperating between said rear post of said sliding window panel and said central post of said fixed window panel;

and lock means positioned on said rear post for cooperation with said central post in a locking and moving action for moving said sliding window panel transversely to its direction of sliding movement in a direction to compress said second weatherstrip means.

17. The sliding window set according to claim 16 wherein the lock means comprises a plurality of lock elements arranged at spaced positions longitudinally of the rear post and common actuating means movable by a single action to actuate each of said lock elements.

18. The sliding window set according to claim 16 wherein the lock means includes a pin mounted on the rear post and movable transversely to the rear post into engagement with the central post, the central post having a blind recess therein for receiving an end portion of the pin to prevent sliding movement of the sliding window panel and to move the sliding window panel transversely to its sliding direction.

19. A sliding door or window set for mounting in an opening in a wall of a building comprising:

an outer frame formed from four separate elongate outer frame elements each of which is formed from a length of a first continuously longitudinally molded profile of constant cross section, the frame elements being connected at four corners to form a rectangular surrounding frame having a horizontal outer top rail, a horizontal outer bottom sill and a first and a second outer vertical jamb;

a fixed window panel having a rectangular fixed window frame mounted within the outer frame having a width so as to extend from the first jamb to a position midway across the outer frame and having a height so as to extend from the outer top rail to the outer bottom sill and a glazing member mounted within the fixed window frame, the fixed window frame being formed from four separate elongate frame elements each formed from a length of a second continuously molded profile of constant cross section and including a central vertical post;

a sliding window panel having a rectangular sliding window frame mounted within the outer frame having a width so as to extend from the second jamb to a position midway across the outer frame and having a height so as to extend from the outer top rail to the outer bottom sill and a glazing member mounted within the sliding window panel frame, the sliding window frame being formed from four separate elongate frame elements each of which is formed from a length of a third continuously molded profile of constant cross section and including a horizontal sliding top rail, a horizontal sliding a bottom rail, a front vertical post and a rear vertical post;

wherein the four separate elongate frame elements of the outer frame are each formed from the same first molded profile of constant cross section, said first molded profile being integrally molded so as to define an inner wall portion facing inwardly toward an opposed one of the outer frame elements an outside wall portion for facing to one side of the wall, an inside wall portion for facing an opposed side of the wall and an outer wall portion including wall elements arranged for engaging the wall of the building, the inner wall portion including an inwardly projecting raised portion engaging the sliding window panel and an inclined sill surface extending from the raised portion and reducing gradually in height from the outer wall portion, each corner being formed by abutting ends of two of the elements which abutting ends are each formed at an angle to the length of the element to define a miter joint between the elements, said fixed window frame being attached to said inclined sill surface of the outer top rail, of the outer bottom sill and of one of said outer vertical jambs.

20. The sliding window set according to claim 19 wherein the molded inwardly projecting raised portion of the first molded profile includes in cross section a hollow support portion defined by surrounding walls forming a hollow interior.

21. The sliding window set according to claim 20, wherein the hollow support portion defines a raised rib having an upper surface and two shoulders formed on respective sides of the rib, each edge of the sliding top rail sliding bottom rail, front post and rear post of the sliding window frame having a recess therein for receiving the rib portion such that the rib portion and the recess act to guide longitudinal movement of the sliding window panel.

22. The sliding window set according to claim 21 wherein the recess has a base surface facing outwardly and two side surfaces extending from the base surface to an outermost edge of the sliding window panel and wherein there is provided a weatherstrip element mounted on one of said side surfaces for engagement with a corresponding side surface of the rib portion.

23. The sliding window set according to claim 21 wherein a length of the rib is removed from the horizontal outer top rail at a position corresponding to an open position of the sliding window panel and wherein there is provided an elongate strip member having an outer surface corresponding in shape to that of the rib and a pair of legs shaped to snap into an opening formed in the horizontal outer top rail by the removal of the rib such that the elongate element can be removed to allow installation and removal of the sliding window panel.

* * * * *